US006890101B2

(12) United States Patent
Blau

(10) Patent No.: US 6,890,101 B2
(45) Date of Patent: May 10, 2005

(54) TRANSPARENT BAG WITH CARD HOLDER

(76) Inventor: Dan Blau, 2584 Joshua La., Northbrook, IL (US) 60062

( * ) Notice: Subject to any disclaimer, the term of this patent is extended or adjusted under 35 U.S.C. 154(b) by 1 day.

(21) Appl. No.: 10/252,624

(22) Filed: Sep. 23, 2002

(65) Prior Publication Data

US 2003/0021501 A1 Jan. 30, 2003

Related U.S. Application Data

(63) Continuation-in-part of application No. 09/902,115, filed on Jul. 10, 2001, now abandoned.

(51) Int. Cl.[7] ..... B65D 30/22
(52) U.S. Cl. ..... 383/40; 383/86; 383/106
(58) Field of Search ..... 383/38, 40, 86, 383/106; 150/139, 145, 147, 152

(56) References Cited

U.S. PATENT DOCUMENTS 597,325 A * 1/1898 Prickett ..... 150/152
1,305,797 A * 6/1919 Henderson ..... 190/109
1,738,802 A * 12/1929 Stanley ..... 150/118
3,422,460 A * 1/1969 Burke et al. ..... 2/73
4,286,639 A * 9/1981 Murphy ..... 206/37
5,354,260 A * 10/1994 Cook ..... 602/13
5,392,974 A * 2/1995 Johnson-Rabbett ..... 224/674
5,695,067 A * 12/1997 Harvey ..... 206/579
D408,992 S * 5/1999 Foster ..... D3/260
6,195,927 B1 * 3/2001 Fortenberry ..... 42/90
D465,323 S * 11/2002 Dancyger ..... D3/226

* cited by examiner

*Primary Examiner*—Jes F. Pascua
(74) *Attorney, Agent, or Firm*—Marshall, Gerstein & Borun LLP

(57) ABSTRACT

A transparent plastic bag or container which is adapted to be used with different products simply by switching descriptive cards which describe the bag's contents. A system for securing the cards in the bag is disclosed. This is achieved by providing an interior retaining strip along the top of the bag. A system for adhering velcro fasteners to plastic bags by means of zig-zag stitching is also disclosed.

6 Claims, 2 Drawing Sheets

TRANSPARENT BAG WITH CARD HOLDER

RELATED APPLICATIONS

This application a Continuation-in-part of U.S. application Ser. No. 09/902,115, filed Jul. 10, 2001 now abandoned.

BACKGROUND OF THE INVENTION

The present invention relates generally to a transparent container or bag. The bag can be used as both as a container for merchandise while in the hands of a retail merchant, and as a vehicle for repackaging and storing the merchandise while in the possession of the retail purchaser. Bags of this type are manufactured of non-rigid plastic sheets which can be easily folded. It is desirable to have at least front and back walls of the container be transparent which makes it easy to see the bag contents. Although the transparent bag can be used for many purposes, the bag is especially useful for displaying and storing cloth books.

The bag has at least one transparent panel which is adapted to hold a display card. This card has substantially the same general width and length as the bag's front or back walls, and typically contains information concerning the contents of the bag, the identity of the manufacturer or distributor, and other information of potential interest to a consumer. Such cards are typically manufactured from light cardboard or stiff paper, but other materials (e.g., plastic) could also be used. In addition to providing information on the contents, the card, once inserted, also functions as a stiffener, adding additional rigidity to the package.

Another desirable feature of a container of this type is ease of opening and closing. Because the bag is designed to be opened and closed on multiple occasions by the purchaser, the closure system should be both simple to use and sturdy. A hook and loop fastening system (commonly marketed under the trademark Velcro®) is ideal for this purpose. Fastening systems incorporating a first Velcro® member on a closure flap and a second closure Velcro® member on a front panel have been previously used. These Velcro® patches have been adhered to the surface of the bag by glue or the like.

SUMMARY OF THE INVENTION

Although transparent bags having display cards are known in the art, one problem has been a system for placing the display cards in the package. Transparent bags of this type should be generic enough so that they can be used for a variety of products, with the display card serving as a major means for differentiating the bags' contents. Thus, on the one hand, the process of inserting the card into the bag should not be labor intensive. On the other hand, the display card should be placed firmly enough in the transparent bag so that the mere act of removing the bag's contents does not result in removal of the card at the same time. Stated another way, the frictional engagement between the card and bag can cause the card to be displaced when the contents are removed. One aspect of the present invention is a solution to this problem.

As noted above, glued-on Velcro® patches have been used as means to open and close such transparent containers. One problem with glued-on patches is that over time the periphery of the Velcro® patches de-laminates from the surface. While the art has attempted to deal with this problem by using stitched-on patches, the sewing methods employed leave an edge portion which can work itself away from the closure flap or the wall of the bag. To the extent that these containers are used to package items for small children, the presence of something which can pose a risk of choking is another problem. Another aspect of the present invention provides a solution to this second problem.

With respect to problem of mounting and maintaining a display card in the transparent container, the present invention utilizes a retaining strip along the top of one wall or panel of the transparent bag. The top edge and one side of the strip is secured to the bag; the bottom strip edge and the other side are open, allowing easy insertion of a display card during the packaging operation.

The issue of a permanently-mounted fastening system is addressed by attaching Velcro® patches by means of continuous zig-zag stitching around the entire periphery of the patches. This method of attachment has been found to withstand repeated closing and unclosing without presenting an area of de-lamination where a small child could attack with fingers or teeth.

BRIEF DESCRIPTION OF THE FIGURES

Other aspects of the present invention will be more clearly understood from an examination of the appended drawings and detailed description, wherein.

DETAILED DESCRIPTION OF THE PREFERRED EMBODIMENT

Figure 1:
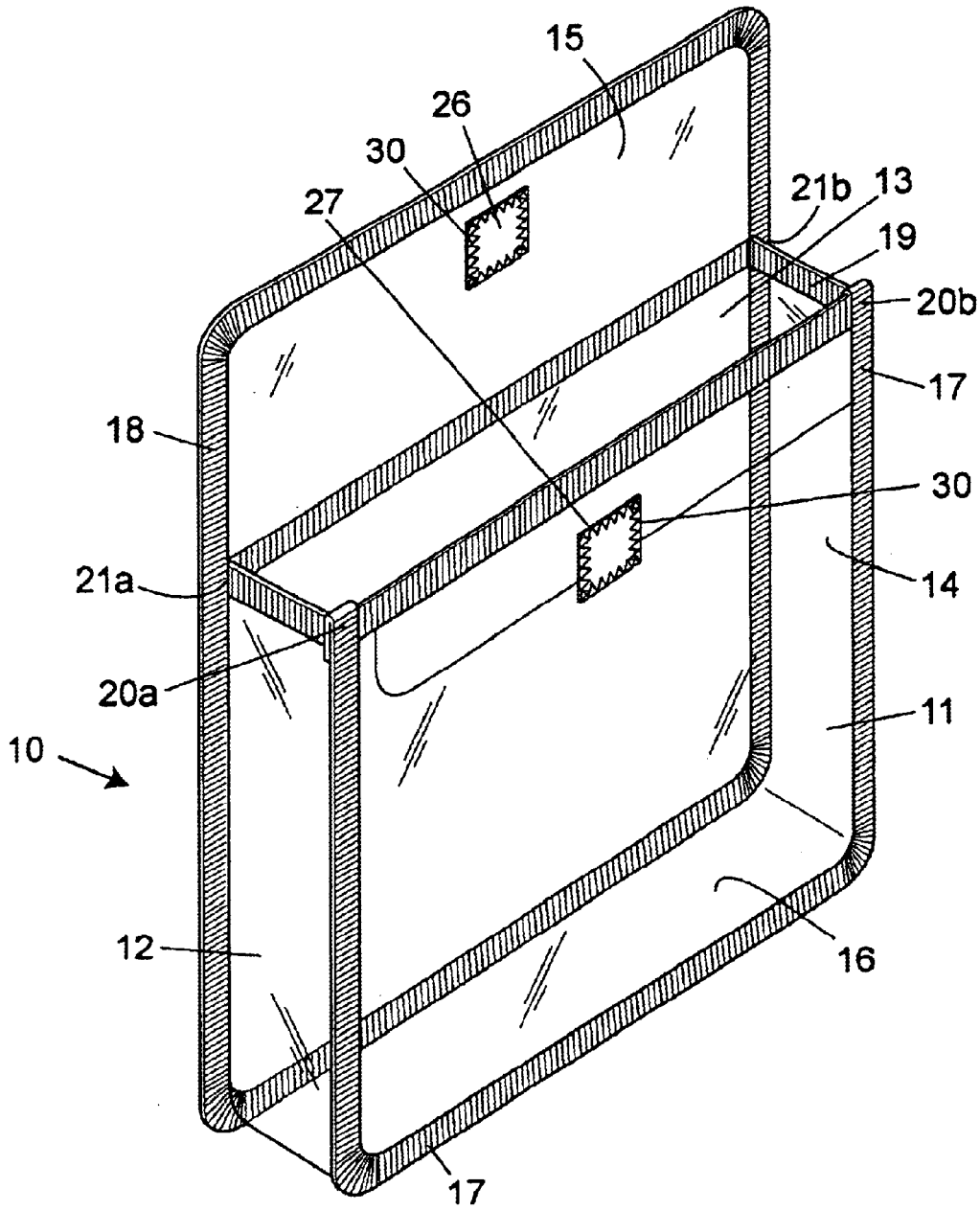
FIG. 1 is a perspective view of a transparent bag of the present invention with the display-card-containing region facing forward.
Figure 2:
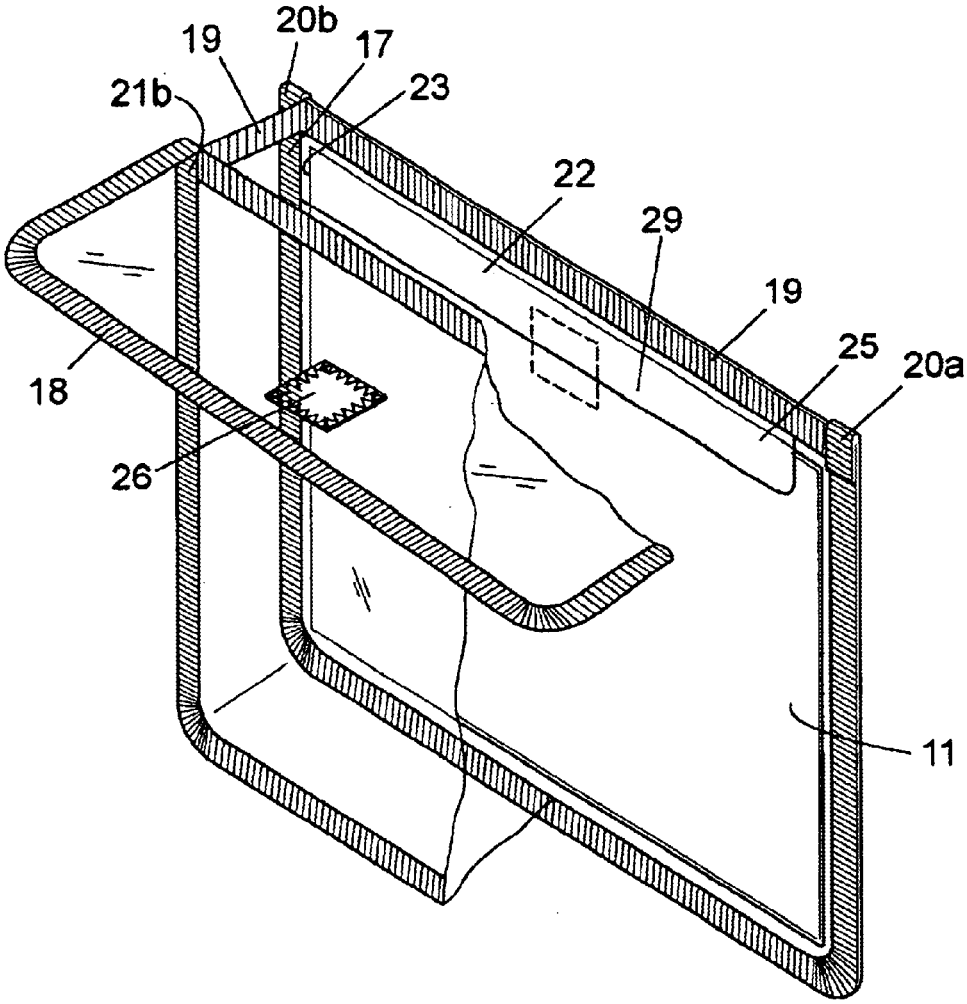
FIG. 2 is a perspective view, partially in section, with the display-card-containing region facing toward the rear.

FIGS. 1 & 2 show a transparent container or bag 10 which is adapted to hold a child's cloth book. Bag 10 has front and back panels 11, 13, side panels 12, 14, a bottom panel 16, and a top, closure flap 15, all of which are manufactured of a clear plastic material. Closure flap 15 is a continuation of (integral with) back panel 13.

As shown in FIG. 1, side panels 12, 14 and bottom panel 16 are formed from a single continuous transparent strip. If desired, these panels can be fabricated from three or two pieces, rather than from a single strip. Moreover, side panels 12, 14 and bottom panel 16 can be formed from a non-transparent material.

The various panels of bag 10 are attached to gusset members 17, 18 and 19 which function both to attach the various plastic panels to one another and to provide rigidity to the bag structure. Thus, rectangular top gusset member 19 interconnects front panel 11, side panels 12 and 14, and rear panel 13, and provides a rectangular opening for insertion of an object, such as a cloth book. A U-shaped front gusset member 17 is mounted around three sides of front panel 11. Front gusset member is attached to top gusset member 19 at 20*a*, 20*b*. Rear gusset member 18 extends around rear panel 13 and its integral closure flap 15. Rear gusset member 18 is attached to top gusset member 19 at 21*a*, 21*b*.

Referring now to FIG. 2, bag 10 has a retaining strip 22 which is mounted inside the bag structure, behind front panel 11. As shown in FIG. 2, retaining strip 22 is manufactured of a clear plastic material having the same characteristics as front panel 11. Indeed, strip 22 can be fashioned by simply bending the top end of panel 11 backwards.

Retaining strip 22 is secured along its top edge by rectangular (top) gusset member 19. A first side end 23 of strip 22 is secured to front gusset 17 slightly below region 20*b*—where gussets 19 and 17 intersect. The opposite or free end 25 of retaining strip 22 is unattached, as is strip bottom edge portion 29, allowing insertion of a rectangular display card (not shown) having approximately the same dimensions as front panel 11 between retaining strip 22 and the back side of front panel 11. This construction allows easy insertion of a display card, but will prevent the card from being dislodged from the bag when items are inserted and (in particular) removed.

In the embodiment illustrated in FIGS. 1 and 2, retaining strip 22 is shown as being mounted behind front panel 11. It is, of course, equally possible to mount retaining strip 22 behind rear panel 13 in the same manner. Indeed, in instances where it is desirable, two retaining strips can be employed, thus allowing the use of two display cards.

A Velcro® hoop fastener patch 26 is mounted to closure flap 15 and a Velcro® loop fastener patch 27 is mounted to front panel 11, permitting bag 10 to be closed. Patches 26, 27 are attached by a sewing operation which employs zig-zag stitching around the entire periphery of the patches to attach them to the surface of bag 10. Zig-zag stitches 30 provide a more secure attachment of patches 26, 26 to flap 15 and panel 11. The nature of the patches attached to each panel can be reversed. That is, a hoop fastener patch 26 can be mounted on front panel 11 and a loop fastener patch 27 on closure flap 15. However, if a hoop-type fastener is employed as the first closure member, a loop-type fastener member must be employed as the second closure member.

What is claimed is:

1. A display bag comprising:

a front panel, a back panel, a bottom panel, and a pair of side panels, said front and back panels formed from a deformable transparent material;

a closure flap integral with said back panel;

a top gusset member interconnecting the front panel, the side panels, and the rear panel, said top gusset member providing a rectangular opening for inserting objects into said plastic bag;

front and rear gusset members securing the front and back panels to the side and bottom panels and to the top gusset member;

a first closure member on said closure flap, and a second closure member on the front panel, said closure members adapted to maintain the closure flap in a closed position when said first closure member is brought into contact with said second closure member; and a retaining strip inside the bag, a top edge of said retaining strip secured by said top gusset member, a first side end of said retaining strip secured by said front gusset, the bottom edge and opposite end of said retaining strip unattached, said retaining strip adapted to removably retain a display card in said bag.

2. A bag in accordance with claim 1 wherein said first and second closure members comprise hook and loop fasteners.

3. A bag in accordance with claim 1 wherein said side and bottom panels comprise a single strip.

4. A bag in accordance with claim 1 wherein said side and bottom panels are transparent.

5. A bag in accordance with claim 1 wherein said retaining strip is mounted behind said front panel.

6. A bag in accordance with claim 1 wherein said retaining strip is formed from a transparent material.

* * * * *